US008496316B2

(12) United States Patent
Suzuki et al.

(10) Patent No.: US 8,496,316 B2
(45) Date of Patent: Jul. 30, 2013

(54) LIQUID EJECTION HEAD AND LIQUID EJECTION APPARATUS

(75) Inventors: Shigeki Suzuki, Shiojiri (JP); Hiroshige Owaki, Okaya (JP); Hiroyuki Kobayashi, Azumino (JP); Hiroyuki Ishii, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/417,126

(22) Filed: Mar. 9, 2012

(65) Prior Publication Data

US 2012/0229568 A1 Sep. 13, 2012

(30) Foreign Application Priority Data

Mar. 10, 2011 (JP) ..... 2011-053623

(51) Int. Cl.
*B41J 2/135* (2006.01)

(52) U.S. Cl.
USPC ..... 347/44; 347/65

(58) Field of Classification Search
USPC ..... 347/44, 40, 43, 47, 64, 65
See application file for complete search history.

(56) References Cited

U.S. PATENT DOCUMENTS 7,980,678 B2 * 7/2011 Fukushima et al. ..... 347/65
8,118,408 B2 * 2/2012 Xie et al. ..... 347/65

FOREIGN PATENT DOCUMENTS

JP 2003-011383 A 1/2003

* cited by examiner

*Primary Examiner* — Lamson Nguyen
(74) *Attorney, Agent, or Firm* — Kilpatrick Townsend & Stockton LLP

(57) ABSTRACT

A liquid ejection head includes a head main body which discharges liquid, a flow path member main body on which a liquid reception member for receiving liquid supplied from the outside is formed, a first case, a second case, and a first insertion portion which is provided on the flow path member main body and through which a securing member for securing the first case, the second case, and the flow path member main body to one another is inserted. In the liquid ejection head, the first insertion portion is formed such that the outer wall covers an exposing portion from which the securing member is exposed.

8 Claims, 4 Drawing Sheets

LIQUID EJECTION HEAD AND LIQUID EJECTION APPARATUS

BACKGROUND

1. Technical Field

The present invention relates to a liquid ejection head and a liquid ejection apparatus which eject liquid, in particular, relates to an ink jet recording head and an ink jet recording apparatus which discharge ink as liquid.

2. Related Art

An ink jet recording head as a representative example of a liquid ejection head is generally configured as follows. That is, the ink jet recording head is generally configured such that ink is supplied to a pressure generation chamber of a head main body through an ink flow path (liquid flow path) from an ink cartridge (liquid storage unit) which is filled with ink. Further, pressure is applied into the pressure generation chamber by a pressure generation unit such as a piezoelectric element so that ink droplets are ejected through a nozzle communicating with the pressure generation chamber.

For example, there is an ink jet recording head having the following configuration as a specific configuration of the ink jet recording head (for example, see JP-A-2003-11383). The ink jet recording head includes head main bodies, a head case to which the plurality of head main bodies are secured, and a cartridge case to which the head case is secured. Further, a circuit substrate which supplies a signal for driving a piezoelectric element is secured between the head case and the cartridge case.

The circuit substrate is held in a flow path member constituted by the head case and the cartridge case. However, most of an outer wall of the flow path member is constituted by an outer wall of the cartridge case. Therefore, if the flow path member is elongated because the flow path member needs to hold the plurality of head main bodies, the outer wall is easily deformed if the outer wall has rigidity which is equivalent to that of an outer wall when the flow path member is small. A space is generated on a joint between the head case and the cartridge case with the deformation. This raises a problem in that liquid enters an inner portion of the flow path member through the space. In particular, when the circuit substrate is provided therein, an electronic part is damaged and a wiring is short-circuited due to the liquid which has entered there. Further, even when the circuit substrate is not held in the flow path member, if liquid enters the inner portion of the flow path member, there arises a problem in that the liquid which has entered there may drop at an unexpected timing and contaminate a recording medium.

Further, if a thickness of the outer wall is increased for solving the above problems, the ink jet recording head is increased in size in addition to an increase in cost and molding failure is easily caused, resulting in a problem in that the ink jet recording head cannot be manufactured with inexpensive molding.

It is to be noted that the above problem arises not only in the ink jet recording head but also in a liquid ejection head which ejects liquid other than ink.

SUMMARY

An advantage of some aspects of the invention is to provide a liquid ejection head and a liquid ejection apparatus which can suppress liquid from entering an inner portion thereof, be suppressed from being increased in size, and reduce cost.

A liquid ejection head according to an aspect of the invention includes a head main body which discharges liquid, a flow path member main body on which a liquid reception member for receiving liquid supplied from the outside is formed, a first case on which a window portion to which the liquid reception member of the flow path member main body faces is formed and which includes a first side wall that extends in a direction of the flow path member main body on a periphery, a second case on which a liquid supply path for receiving liquid supplied from the liquid reception member of the flow path member main body is formed and which includes a second side wall that extends in a direction of the flow path member main body and forms an outer wall on a periphery of a case together with the first side wall, and a first insertion portion which is provided on the flow path member main body and through which a securing member for securing the first case, the second case, and the flow path member main body to one another is inserted. In the liquid ejection head, the first insertion portion is formed such that the outer wall covers an exposing portion from which the securing member is exposed.

In the aspect of the invention, the outer wall of the case is formed by the first side wall of the first case and the second side wall of the second case. With this, rigidity of the outer wall is improved so as to make the outer wall hard to be deformed, thereby suppressing liquid from entering the inner portion of the case through the outer wall. Further, the case can be suppressed from being increased in size by providing the exposing portion.

It is preferable that the liquid ejection head further include a circuit substrate which is arranged between the flow path member main body and the second case and supplies an electric signal to a pressure generation element of the head main body, and the first insertion portion be provided between the circuit substrate and the outer wall of the case. With this, liquid can be suppressed from adhering to the circuit substrate so as to suppress an electronic part from being damaged and short-circuited.

Further, it is preferable that the liquid ejection head further include a securing portion which is provided on the first case, and is inserted into the first insertion portion of the flow path member main body and to which the securing member is secured, and a second insertion portion which is provided on the second case and through which the securing member is inserted so as to engage with the first insertion portion of the flow path member main body, and a position of a boundary between the first side wall and the second side wall and a position at which the first insertion portion, the securing portion and the second insertion portion abut against one another be arranged to be different from each other in a direction in which the first case, the flow path member main body and the second case are laminated. With this, even if liquid enters through the boundary between the first side wall and the second side wall, the position at which the first insertion portion, the securing portion and the second insertion portion abut against one another is farther from the boundary. Therefore, liquid can be suppressed from entering the inner portion.

Further, it is preferable that the outer wall formed by the first side wall and the second side wall correspond to at least side walls at long sides of the case. With this, rigidity of side walls at long sides, which are easily deteriorated, in particular, can be improved.

It is preferable that a liquid ejection apparatus according to another aspect of the invention further include the liquid ejection head in the aspect of the invention.

With the aspect of the invention, a liquid ejection apparatus which is suppressed from being damaged and is reduced in size can be realized.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be described in detail based on embodiments.

First Embodiment

Figure 1:
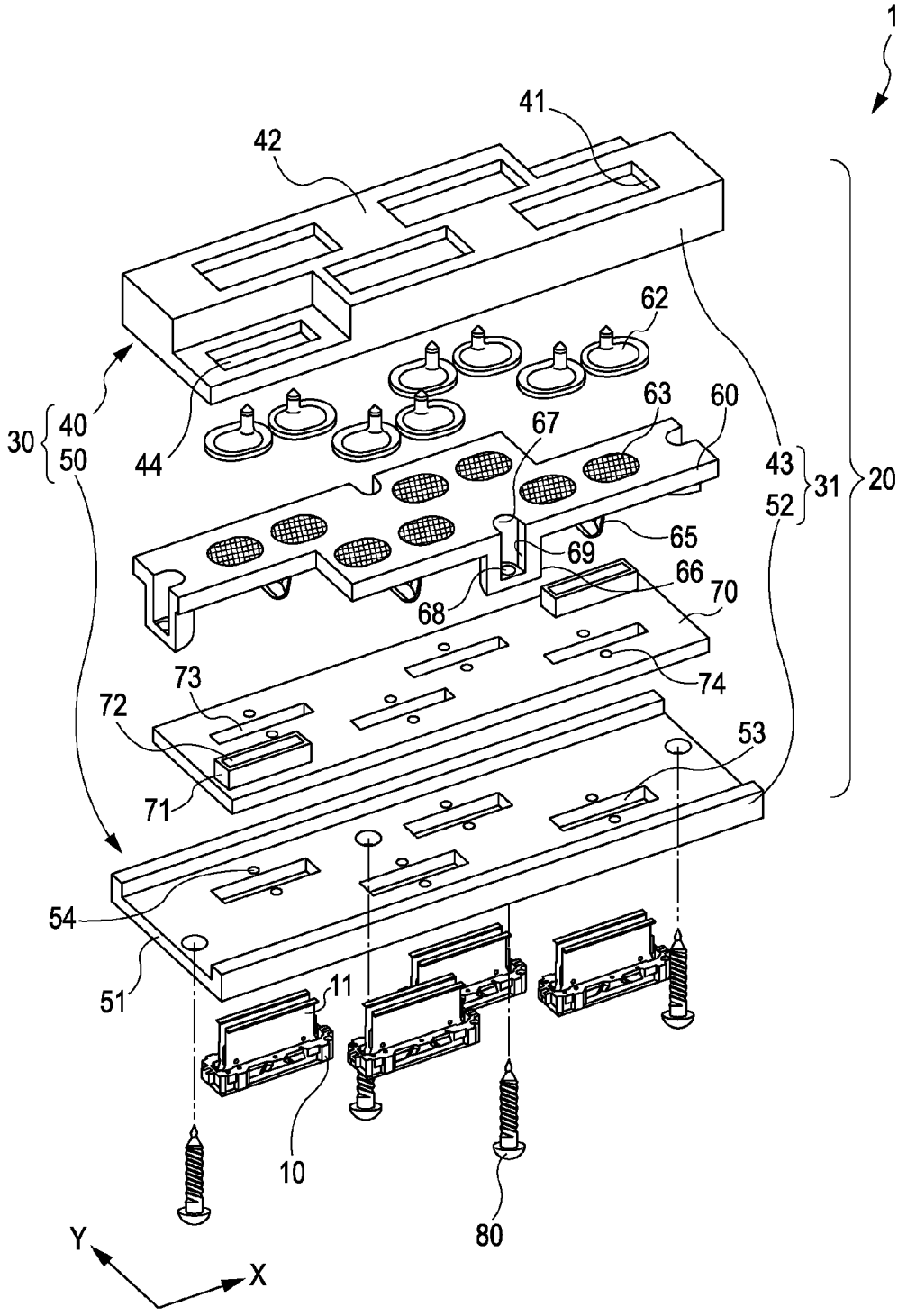
FIG. 1 is an exploded perspective view illustrating a recording head according to a first embodiment of the invention.
Figure 2:
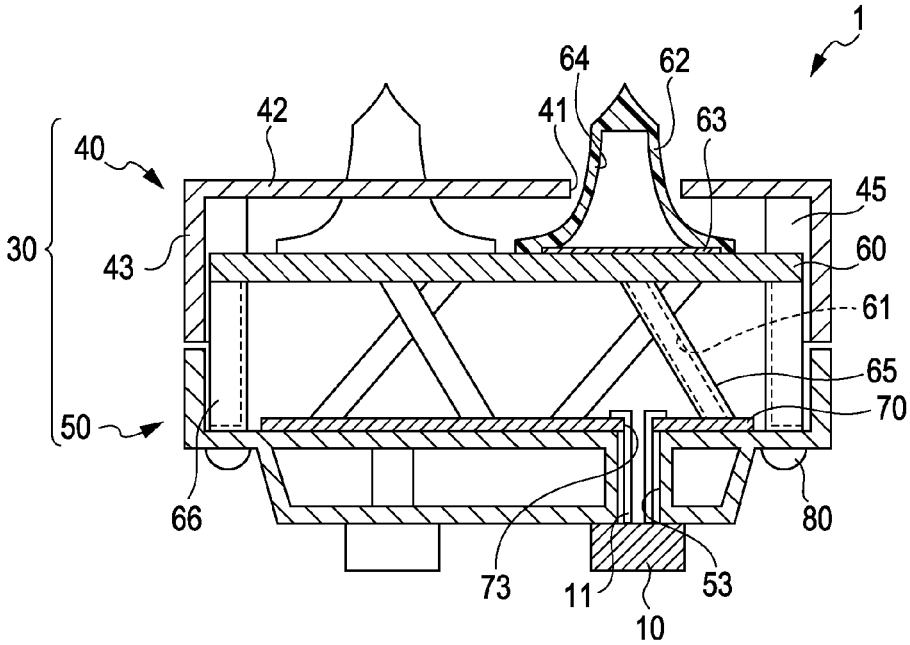
FIG. 2 is a cross-sectional view illustrating the recording head according to the first embodiment of the invention.
Figure 3:
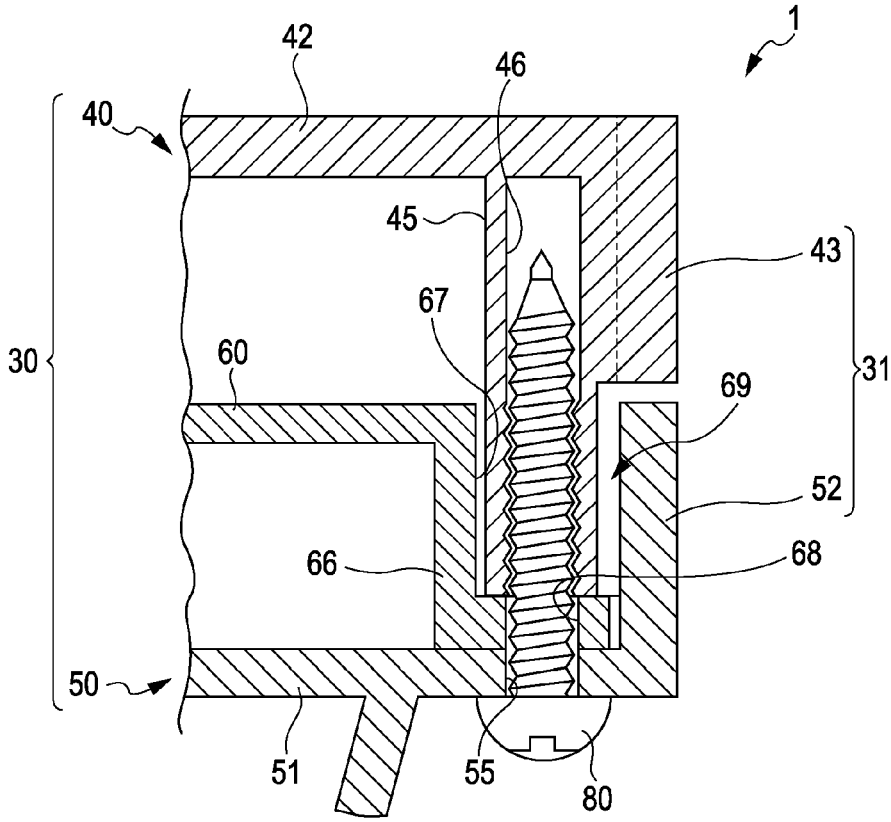
FIG. 3 is a cross-sectional view illustrating the main part of the recording head according to the first embodiment of the invention.

FIG. 1 is an exploded perspective view illustrating an ink jet recording head as an example of a liquid ejection head according to a first embodiment of the invention. FIG. 2 is a cross-sectional view illustrating the ink jet recording head. FIG. 3 is a cross-sectional view illustrating the main part of the ink jet recording head.

As illustrated in the drawings, an ink jet recording head 1 (hereinafter, also referred to as head 1 simply) includes head main bodies 10 which discharge ink droplets as liquid and a flow path member 20 as a holding member which holds the head main bodies 10.

The flow path member 20 includes a case 30, a flow path member main body 60, and a circuit substrate 70. The case 30 has a first case 40 and a second case 50. The flow path member main body 60 is held in the case 30. The circuit substrate 70 is held in the case 30. The first case 40 and the second case 50 are secured by fastening members 80 as securing members, such as screws, in a state where the flow path member main body 60 and the circuit substrate 70 are held therein.

The flow path member main body 60 has a shape that has corner portions as a pair of diagonal corners cut out in a rectangular shape as a standard when seen from the above. Further, liquid supply paths 61 are formed on the flow path member main body 60. One ends of the liquid supply paths 61 are opened to the side of the first case 40 and the other ends thereof are opened to the side of the second case 50. Further, ink supply needles 62 as liquid reception members are secured to the opening portions of the liquid supply paths 61 of the flow path member main body 60 at the side of the first case 40. The ink supply needles 62 are secured to the opening portions through filters 63 which are formed on the liquid supply paths 61 in order to remove air bubbles and foreign matters in ink. Penetrating paths 64 which communicate with the liquid supply paths 61 are provided in the respective ink supply needles 62 which are secured to the flow path member main body 60 in this manner. Further, a storage unit (not illustrated) such as an ink cartridge is connected to the ink supply needles 62 directly or through tubes or the like. With this, ink from the storage unit is supplied to the liquid supply paths 61 through the penetrating paths 64 of the ink supply needles 62. In the embodiment, eight liquid supply paths 61 are provided and the filters 63 and the ink supply needles 62 are provided on the opening portions of the respective liquid supply paths 61. That is to say, eight ink supply needles 62 are provided in the embodiment. As shapes of tips of the ink supply needles 62, acute shapes or cylindrical shapes where the tips thereof are not acute are employed. However, the shapes of the tips of the ink supply needles 62 are not limited to these shapes and it is sufficient that the tips of the ink supply needles 62 have such shapes that liquid can be supplied from the storage unit thereto.

It is to be noted that tubed flow path formation portions 65 are provided on the flow path member main body 60 in a perforated manner. To be more specific, the flow path formation portions 65 are provided at an opposite surface side of the ink supply needles 62. The liquid supply paths 61 are formed in the flow path formation portions 65. Further, the circuit substrate 70 is held between the flow path formation portions 65 and the second case 50.

Further, first insertion portions 66 which project to the side of the second case 50 are provided on the flow path member main body 60. In the embodiment, the first insertion portions 66 are provided on four sides of the rectangular shape as a standard when the flow path member main body 60 is seen from the above. That is to say, four first insertion portions 66 in total are provided in the embodiment.

As illustrated in FIG. 1 and FIG. 3, insertion holes 67 and holding holes 68 are provided on the first insertion portions 66 in cylindrical shapes as a standard. Securing portions 45 of the first case 40, which will be described later, are inserted into the insertion holes 67. The holding holes 68 are provided on front end surfaces at the side of the second case 50 so as to communicate with the insertion holes 67. Each holding hole 68 has an inner diameter which is smaller than that of each insertion hole 67. Further, exposing portions 69 are provided on the first insertion portions 66. Each exposing portion 69 is formed by cutting out a part of a wall constituting each insertion hole 67. The exposing portions 69 are covered by an outer wall 31 of the case 30 when the flow path member main body 60 is held in the case 30.

The first case 40 has a substantially box shape of which second case 50 side is opened. The first case 40 includes a plate-like first base portion 42 and a first side wall 43. Window portions 41 from which the ink supply needles 62 are exposed are provided on the first base portion 42 on regions which the ink supply needles 62 face. The first side wall 43 is provided so as to project to the side of the second case 50 over a peripheral portion of the first base portion 42.

One window portion 41 is provided for every two ink supply needles 62. It is sufficient that each window portion 41 has such size that the tips of the ink supply needles 62 are exposed therefrom. If each window portion 41 is made too large, there arises a risk that foreign matters enter through the window portion 41. Therefore, each window portion 41 has a minimum size to be required.

Further, as illustrated in FIG. 1, wiring connection ports 44 are provided on the first base portion 42 of the first case 40 so as to penetrate through the first base portion 42. To be more specific, the wiring connection ports 44 are provided on regions opposed to entry holes 72 of connectors 71 provided on the circuit substrate 70 held in the case 30. Wirings from the outside (external wirings) are connected to the connectors 71 on the circuit substrate 70 held inside through the wiring connection ports 44 of the first case 40.

Further, as illustrated in FIG. 2 and FIG. 3, the securing portions 45 which are provided so as to project to the side of the second case 50 are provided on the first base portion 42 of the first case 40. The securing portions 45 are inserted into the insertion holes 67 of the first insertion portions 66 provided on the flow path member main body 60. Further, securing holes 46 are provided on the securing portions 45. The securing holes 46 are opened on front end surfaces of the securing portions 45 in the projecting direction. The fastening members 80 which have been inserted through second insertion portions 55 provided on the second case 50 are screwed into the securing holes 46. In this manner, the first case 40 and the second case 50 are integrated with each other to constitute the case 30. Further, the fastening members 80 are inserted through the holding holes 68 of the first insertion portions 66 of the flow path member main body 60 so as to be screwed into the securing holes 46. With this, the flow path member main body 60 is held between the front end surfaces of the securing portions 45 and the second case 50. Therefore, each holding hole 68 has an inner diameter which is larger than that of a portion of each fastening member 80, which is fastened.

Further, the first side wall 43 of the first case 40 is provided so as to project to the side of the second case 50 around an outer circumference of the first base portion 42. The first side wall 43 is formed so as to project by an amount which is smaller than a projection amount of each securing portion 45 in the embodiment. Further, the first side wall 43 is provided to be continuous to the securing portions 45. It is needless to say that the first side wall 43 and the securing portions 45 are continuous to one another through the first base 42. However, a configuration in which parts of side walls of the securing portions 45 are connected to the first side wall 43 directly from the side walls of the securing portions 45 is employed. That is to say, the side walls of the securing portions 45 have a beam-like function with the first side wall 43. With this, rigidity of the securing portions 45 can be improved and fracture or the like can be suppressed from being generated in comparison with a case where the securing portions 45 and the first side wall 43 are continuous to one another through the first base portion 42 only.

Although not specially illustrated in the drawings, the circuit substrate 70 is formed by a plate-like member on which electronic parts and various wirings for driving pressure generation units provided on the head main bodies 10 are mounted. Further, as illustrated in FIG. 1, connection holes 73 which penetrate through the circuit substrate 70 in the thickness direction are provided on the circuit substrate 70. Further, driving wirings 11 of the head main bodies 10 are inserted through the connection holes 73 and front ends of the driving wirings 11 are folded along a surface of the circuit substrate 70 so as to be electrically connected to various wirings and the like of the circuit substrate 70.

Further, the circuit substrate 70 has a rectangular shape when seen from the above (when visually recognized from the side of the first case) and the connectors 71 are provided on corner portions as a pair of diagonal corners. The connectors 71 are electrically connected to various wirings and the like provided on the circuit substrate 70 and secured such that the entry holes 72 to which external wirings are connected are opened to the side of the first case 40. Further, the flow path member main body 60 is made to have a shape that regions (corner portions as a pair of diagonal corners) opposed to the regions on which the connectors 71 of the circuit substrate 70 are provided are cut out. With this, the entry holes 72 of the connectors 71 of the circuit substrate 70 are exposed in the wiring connection ports 44 of the first case 40. Accordingly, external wirings such as a flexible flat cable (FFC) can be connected to the entry holes 72 of the connectors 71.

The circuit substrate 70 having such configuration is held between the flow path member main body 60 and the second case 50. Further, a size of the circuit substrate 70 is smaller than an outer circumference of the flow path member main body 60 when seen from the side of the first case 40. Therefore, when the circuit substrate 70 is held in the case 30, the first insertion portions 66 of the flow path member main body 60 are provided between the circuit substrate 70 and the outer wall 31 of the case 30.

The second case 50 includes a second base portion 51 and second side walls 52. The second base portion 51 has a rectangular shape when seen from the above (when visually recognized from the side of the first case 40). The second side walls 52 are provided on long sides of the second base portion 51 when seen from the above and are provided so as to project from the second base portion 51 to the side of the first case 40.

The plurality of head main bodies 10 are secured to a surface of the second base portion 51 of the second case 50 at the side opposite to the first case 40. Further, the insertion holes 53 which penetrate through the second base portion 51 in the thickness direction are provided on the second base portion 51 of the second case 50 so as to correspond to the head main bodies 10. The driving wirings 11 of the head main bodies 10 held on the second case 50 are inserted through the insertion holes 53 so as to be connected to the circuit substrate 70. Further, as illustrated in FIG. 1, supply communicating paths 54 of which one ends are connected to the liquid supply paths 61 of the flow path member main body 60 are provided around the insertion holes 53 of the second base portion 51. Further, the other ends of the supply communicating paths 54 are connected to flow paths (not illustrated) of the head main bodies 10 so that ink from the liquid supply paths 61 is supplied to the head main bodies 10 through the supply communicating paths 54. It is to be noted that the supply communicating paths 54 are actually connected to the liquid supply paths 61 of the flow path member main body 60 through flow paths 74 provided on the circuit substrate 70. In this case, if sealing members made of an elastic member such as a rubber are provided on connecting portions of the liquid supply paths 61, the flow paths 74, the supply communicating paths 54 and the flow paths (not illustrated) of the head main bodies 10, which are connected to one another, ink can be prevented from being leaked on the connecting portions of the flow paths.

Further, when the first case 40 and the second case 50 are integrated with each other with the fastening members 80, the second side walls 52 of the second case 50 are opposed to a front end surface of the first side wall 43 of the first case 40 so as to constitute the outer wall 31 of the case 30 together with the first side wall 43. As illustrated in FIG. 3, the first side wall 43 and the second side walls 52 are secured to one another in a state where predetermined spaces are formed between the front end surfaces thereof which are opposed to one another. Meniscuses are formed with ink on the spaces between the first side wall 43 and the second side walls 52 when the ink tries to enter through the spaces between the first side wall 43 and the second side walls 52. Therefore, the spaces make it possible to suppress the ink from entering the inner portion of the case 30. It is needless to say that the front end surfaces of the first side wall 43 and the second side walls 52 may be abutted against one another or elastic members such as a sealing member may be sandwiched between the front end surface of the first side wall 43 and the front end surfaces of the second side walls 52 so as to suppress ink from entering. Further, boundaries between the first side wall 43 and the second side walls 52 may be sealed with resins or the like.

Further, the second insertion portions 55 are provided on the second base portion 51 on regions which are opposed to the first insertion portions 66. Each second insertion portion 55 has an inner diameter which is substantially the same as that of each holding hole 68 of each first insertion portion 66 and has an inner diameter which is smaller than that of a head portion of each fastening member 80.

Further, in a state where the first case 40 is superimposed on the flow path member main body 60 from the side of the ink supply needles 62 and the circuit substrate 70 is sandwiched between the flow path member main body 60 and the second case 50, the first case 40 and the second case 50 are secured to each other with the fastening members 80. With this, the first case 40 and the second case 50 are integrated with each other so that the case 30 is formed while the flow path member main body 60 and the circuit substrate 70 are held in the case 30. In this manner, the integrated flow path member 20 is formed.

To be more specific, as illustrated in FIG. 3, in the embodiment, the fastening members 80 are male screws and are inserted through the second insertion portions 55 of the second case 50 from the side of the head main bodies 10. The fastening members 80 which have been inserted through the second insertion portions 55 are inserted through the holding holes 68 of the first insertion portions 66 of the flow path member main body 60 so as to be screwed into the securing holes 46 of the securing portions 45 of the first case 40. With this, the front ends of the first insertion portions 66 of the flow path member main body 60 are sandwiched between the front end surfaces of the securing portions 45 of the first case 40 and the second base portion 51 of the second case 50. Further, if the flow path member main body 60 is held in this manner, the circuit substrate 70 is sandwiched between the flow path member main body 60 and the second base portion 51 of the second case 50.

Further, the exposing portions 69 of the first insertion portions 66 of the flow path member main body 60 are covered by the outer wall 31 of the case 30 on the flow path member 20 which has been integrated in the above manner. Therefore, the outer wall 31 of the case 30 can serve as walls of the insertion holes 67 even if the exposing portions 69 and the insertion holes 67 are not covered by their own walls. Accordingly, the outer wall 31 of the case 30 serves as a part of the walls of the insertion holes 67, thereby suppressing the flow path member 20 from being increased in size.

Figure 4:
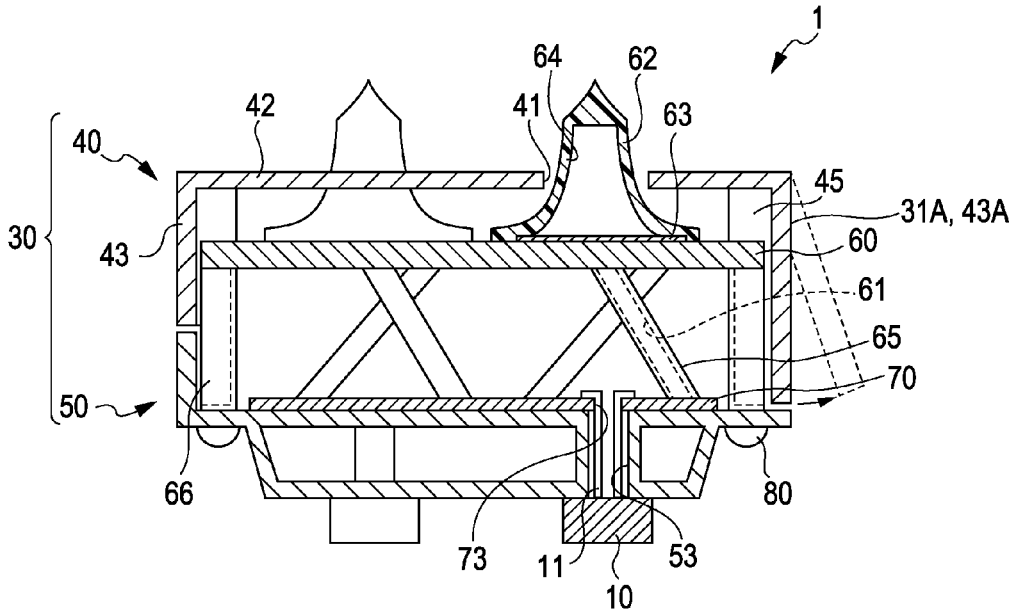
FIG. 4 is a cross-sectional view illustrating a comparative example of a recording head according to the first embodiment of the invention.

For example, as illustrated in FIG. 4, if an outer wall 31A of the case 30 is formed by only one side wall (in an example of FIG. 4, side wall 43A of the first case 40) of the first case 40 and the second case 50, the side wall 43A becomes longer and rigidity thereof is lowered so that the outer wall 31A is easily deformed. If the outer wall 31A is deformed, a space between the first case 40 and the second case 50 is easily increased and ink may enter the inner portion of the case 30 so that the electronic parts are to be damaged, short-circuited, or the like. Further, if the outer wall 31A of the first case 40 or the second case 50 is made thicker for improving rigidity thereof, cost and size are increased. In addition, if a longer outer wall 31A is molded, molding failure may be caused. Therefore, the flow path member 20 cannot be manufactured with inexpensive molding.

In the embodiment, the outer wall 31 of the case 30 is formed by the first side wall 43 of the first case 40 and the second side walls 52 of the second case 50. Therefore, the first side wall 43 and the second side walls 52 can be made shorter and rigidity of the first side wall 43 and the second side walls 52 can be improved. Therefore, the first side wall 43 and the second side walls 52 can be made hard to be deformed. Accordingly, entering ink into the inner portion of the case 30 due to the deformation of the outer wall 31 can be suppressed from occurring. This makes it possible to suppress undesired ink drop to the side of a discharge medium or damage and electrical short of the electronic parts from occurring. In addition, the rigidity of the first side wall 43 and the second side walls 52 can be improved so that the thickness of the first side wall 43 and the second side walls 52 can be made relatively thinner so as to suppress the flow path member 20 from being increased in size. Further, molding failure can be suppressed from occurring, thereby realizing mass production with an inexpensive manufacturing method.

Further, in the embodiment, the exposing portions 69 are provided on the first insertion portions 66 of the flow path member main body 60 and the exposing portions 69 are covered by the outer wall 31 of the case 30. Therefore, the flow path member 20 can be suppressed from being increased in size.

Figure 5:
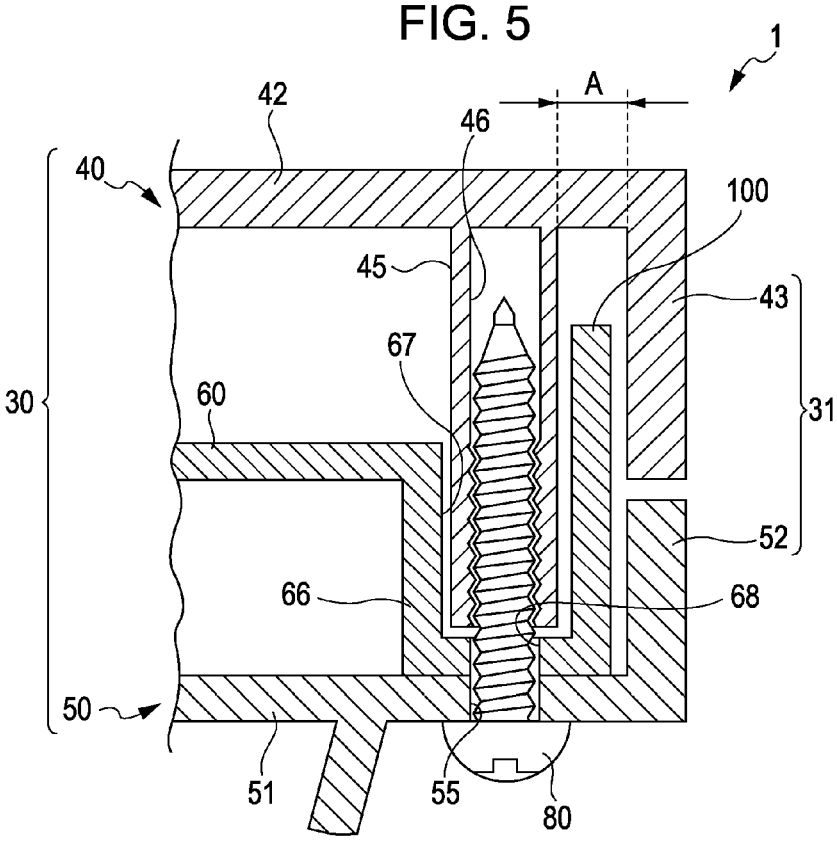
FIG. 5 is a cross-sectional view illustrating the main part of the comparative example of the recording head according to the first embodiment of the invention.

For example, as illustrated in FIG. 5, if the exposing portions 69 are not provided on the first insertion portions 66 of the flow path member main body 60 and a wall 100 is provided between the first insertion portions 66 and the outer wall 31 of the case 30, even if the outer wall 31A is formed by only one of the first case 40 and the second case 50 as illustrated in FIG. 4 and the rigidity of the outer wall is lowered, the rigidity of the first insertion portions 66 are improved by the wall 100. Therefore, rigidity of the entire flow path member 20 is improved so as to make ink difficult to enter the inner portion. However, in this case, a space A for providing the wall 100 between the first insertion portions 66 and the outer wall 31 needs to be ensured. Therefore, the flow path member 20 is undesirably increased in size by an amount of the space A for providing the wall 100.

In the embodiment, the exposing portions 69 are provided on the first insertion portions 66 and covered by the outer wall 31 of the case 30. With this, the space A for providing the wall 100 is not required so as to reduce the flow path member 20 in size. In addition, if the exposing portions 69 are provided on the first insertion portions 66, the securing portions 45 and the first side wall 43 of the first case 40 can be made continuous to one another. In particular, the side walls of the securing portions 45 are continuous to the first side wall 43. Therefore, the securing portions 45 and the first side wall 43 can be reinforced with one another to improve the rigidity thereof, thereby making them hard to be deformed and damaged. Note that as illustrated in FIG. 5 as described above, when the wall 100 is provided on the flow path member main body 60, since the securing portions 45 and the first side wall 43 are separated from one another with the wall 100, they cannot be continuous to one another.

Further, in the embodiment, the securing portions 45 project to the side of the second case 50 than to the first side wall 43 on the first case 40. Therefore, positions of boundaries between the first side wall 43 and the second side walls 52 and positions at which the first insertion portions 66, the securing portions 45 and the second insertion portions 55 abut against one another are arranged to be different from each other in a direction in which the first case 40, the flow path member main body 60 and the second case 50 are laminated. Note that the positions at which the first insertion portions 66, the securing portions 45 and the second insertion portions 55 abut against one another indicate portions secured by the fastening members 80. That is, in the embodiment, the positions indicate positions at which the front end surfaces of the securing portions 45 at the side of the second case 50 and inner surfaces of the front end portions of the first insertion portions 66 abut against one another and positions at which the front end surfaces of the first insertion portion 66 and a surface of the second case 50 at the side of the first case 40 abut against one another. Further, the first insertion portions 66 of the flow path member main body 60 are provided between the circuit substrate 70 and the outer wall 31 of the case 30. With this, the positions of the boundaries between the first side wall 43 and the second side walls 52 and the positions at which the first insertion portions 66, the securing portions 45 and the second insertion portions 55 abut against one another are separated from each other. Therefore, even if ink enter through the boundaries between the first side wall 43 and the second side walls 52, entering ink into the side of the circuit substrate 70 through the portions at which the first insertion portions 66, the securing portions 45 and the second insertion portions 55 abut against one another can be suppressed from occurring.

It is to be noted that the plurality of head main bodies 10 are secured to the flow path member 20 in the embodiment as described above. Nozzle openings (not illustrated) are arranged in parallel on the head main bodies 10. The plurality of head main bodes 10 are arranged in a zigzag form toward the parallel arrangement direction of the nozzle openings so that the nozzle rows elongated can be formed at the same pitch in the parallel arrangement direction of the nozzle openings. It is to be noted that the head main bodies 10 are arranged in the zigzag form in the following manner as illustrated in FIG. 1. That is, the plurality of head main bodies 10 are arranged in parallel toward a first direction X as the parallel arrangement direction of the nozzle openings and rows constituted by the plurality of head main bodies 10 arranged in parallel in the parallel arrangement direction of the nozzle openings are provided to be lined in a second direction Y intersecting with the first direction X. These two rows of the head main bodies 10 which are arranged in parallel in the second direction Y are arranged at positions slightly deviated from each other in the first direction X. Further, adjacent head main bodies 10 on the two rows of the head main bodies 10 are provided such that the nozzle opening at an end side of the nozzle row of the head main body 10 at one row and a nozzle opening at an end side of the nozzle row of the head main body 10 at the other row are provided at the same position in the first direction X of the nozzle openings. With this, the nozzle rows can be continuous by arranging the nozzle openings in parallel for the plurality of head main bodies 10 at the same pitch along the first direction X. Therefore, ink can be discharged onto a wide recording medium over a large area with a width of the continuous nozzle rows by the plurality of head main bodies 10. Further, the flow path member 20 on which the head main bodies 10 are arranged is elongated in the first direction X. Therefore, the rigidity of the outer wall 31 of the case 30 as described above is easily lowered. However, in the embodiment, the outer wall 31 of the case 30 is formed by the first side wall 43 of the first case 40 and the second side walls 52 of the second case 50. Therefore, the first side wall 43 and the second side walls 52 can be made shorter and rigidity of the first side wall 43 and the second side walls 52 can be improved so as to make them hard to be deformed. Accordingly, entering ink into the inner portion of the case 30 can be suppressed from occurring.

Note that since the second side walls 52 are provided on only the long sides of the second case 50 in the embodiment, the outer wall 31 at the short sides of the second case 50 is constituted by only the first side wall 43 of the first case 40. However, the rigidity is higher at the short sides of the second case 30. Therefore, even if the second side walls 52 are not provided at the short sides thereof, the first side wall 43 is hard to be deformed so that ink can be suppressed from entering there. It is needless to say that the second side walls 52 may be also provided on the short sides of the case 30 and the outer wall 31 at the short sides may be also constituted by the first side wall 43 and the second side walls 52.

Other Embodiments

An embodiment of the invention has been described thus far. However, the basic configuration of the invention is not limited to the above configuration. For example, in the above first embodiment, the head 1 having the flow path member 20 in which the circuit substrate 70 is held has been described as an example. However, the head is not particularly limited thereto and the circuit substrate 70 may not be held in the flow path member 20. When the circuit substrate 70 is not held in the flow path member 20, if ink enters an inner side of the flow path member 20, there arises a problem in that ink drops on a recording medium at an unexpected timing so as to contaminate the recording medium, or the like. However, if the outer wall 31 is formed by the first side wall 43 and the second side walls 52 as described above, the rigidity thereof is improved so as to suppress the ink from entering the inner portion of the case 30, thereby suppressing the recording medium from being contaminated. It is needless to say that a valve body for keeping a pressure at a downstream side of a flow path may be provided in the flow path member 20 or another member and function may be held.

Further, in the above first embodiment, the securing portions 45 are provided on the first case 40 and the fastening members 80 are screwed into the securing holes 46 of the securing portions 45 so as to integrally form the flow path member 20. However, a configuration is not limited thereto. For example, a configuration in which the securing holes 46 are made to be through-holes which penetrate through the first case 40 in the thickness direction and front ends of the fastening members 80 which have been inserted through the through-holes are fastened with nuts provided on the first case 40 at an upper surface side (side opposite to the second case 50) may be employed.

Figure 6:
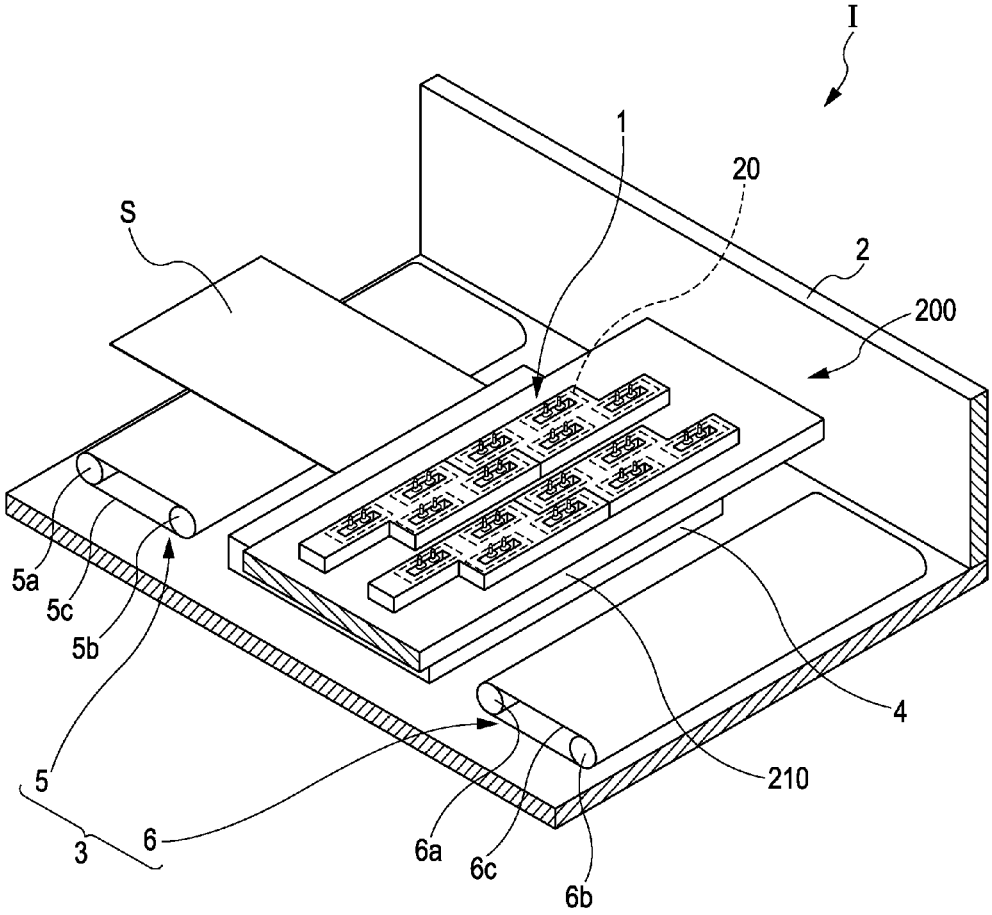
FIG. 6 is a schematic perspective view illustrating a recording apparatus according to an embodiment of the invention.

In addition, the heads 1 according to each of the above embodiments constitute an ink jet recording head module 200 (hereinafter, also referred to as head module 200) as an example of a liquid ejection head module. To be more specific, as illustrated in FIG. 6, the plurality of (for example, four in the embodiment) heads 1 are secured to a securing member so as to constitute the ink jet recording head module 200. The head module 200 is mounted on an ink jet recording apparatus as an example of a liquid ejection apparatus. Then, an ink jet recording apparatus according to the embodiment is described. Note that FIG. 6 is a schematic perspective view illustrating an ink jet recording apparatus as an example of the liquid ejection apparatus according to the first embodiment of the invention.

As illustrated in FIG. 6, the ink jet recording apparatus according to the embodiment is a so-called line-type recording apparatus in which the head module 200 is secured and a recording sheet S as a recording medium, such as a paper, is transported so as to perform printing.

To be more specific, an ink jet recording apparatus I includes an apparatus main body 2, the head module 200, a transportation unit 3, and a platen 4. The head module 200 is secured to the apparatus main body 2. The transportation unit 3 transports the recording sheet S as the recording medium. The platen 4 supports a rear surface side of the recording sheet S, which is opposite to a printing surface opposed to the head module 200.

The transportation unit 3 includes a first transportation unit 5 and a second transportation unit 6. The first transportation unit 5 and the second transportation unit 6 are provided at both sides with respect to the head module 200 in the transportation direction of the recording sheet S.

The first transportation unit 5 is constituted by a driving roller 5*a*, a driven roller 5*b*, and a transportation belt 5*c* which is wound around the driving roller 5*a* and the driven roller 5*b*. Further, the second transportation unit 6 is constituted by a driving roller 6*a*, a driven roller 6*b*, and a transportation belt 6*c* as in the first transportation unit 5.

A driving unit such as a driving motor (not illustrated) is connected to each of the driving rollers 5*a*, 6*a* of the first transportation unit 5 and the second transportation unit 6. The transportation belts 5*c*, 6*c* are rotationally driven by driving forces of the driving units so that the recording sheet S is transported from an upstream side to a downstream side of the head module 200.

It is to be noted that in the embodiment, the first transportation unit 5 and the second transportation unit 6 which are constituted by the driving rollers 5*a*, 6*a*, the driven rollers 5*b*, 6*b*, and the transportation belts 5*c*, 6*c*, respectively, have been described as an example. However, holding units which hold the recording sheet S on the transportation belts 5*c*, 6*c* may be further provided. The holding units may have a configuration in which a charger which charges an outer circumferential surface of the recording sheet S is provided and the recording sheet S charged by the charger is adsorbed onto the transportation belts 5*c*, 6*c* with an action of dielectric polarization, for example. Alternatively, the holding units may have a configuration in which pressure rollers are provided on the transportation belts 5*c*, 6*c* and the recording sheet S is nipped between the pressure rollers and the transportation belts 5*c*, 6*c*.

The platen 4 is provided between the first transportation unit 5 and the second transportation unit 6 so as to be opposed to the head module 200. The platen 4 has a rectangular cross section and is made of a metal, resin, or the like. The platen 4 supports the recording sheet S transported by the first transportation unit 5 and the second transportation unit 6 at a position opposed to the head module 200.

It is to be noted that an adsorption unit which adsorbs the transported recording sheet S on the platen 4 may be provided on the platen 4. As the adsorption unit, for example, an adsorption unit which sucks the recording sheet S to adsorb it, an adsorption unit which electrostatically adsorbs the recording sheet S with an electrostatic force, or the like can be used.

Further, although not illustrated in the drawing, a storage unit such as an ink tank or an ink cartridge in which ink is stored is connected to the head module 200 such that ink can be supplied from the storage unit. For example, the storage unit may be held on the head module 200, or may be held at a position which is different from the head module 200 in the apparatus main body 2 and be connected to each ink supply needle of each head 1 through a tube or the like. Further, an external wiring (not illustrated) is connected to each head 1 of the head module 200.

In the ink jet recording apparatus I having the above configuration, the recording sheet S is transported by the transportation unit 3 and printing is executed on the recording sheet S which is supported on the platen 4 by the head module 200. The printed recording sheet S is transported by the transportation unit 3.

In the example as illustrated in FIG. 6, the so-called line-type ink jet recording apparatus I in which the heads 1 (head module 200) are secured to the apparatus main body 2 and printing is performed only by transporting the recording sheet S has been described. However, the invention is not particularly limited thereto and can be applied to a so-called serial-type recording apparatus in which the heads 1 (head module 200) are mounted on a carriage which moves in a main scanning direction intersecting with a transportation direction of the recording sheet S and printing is performed while moving the heads 1 (head module 200) in the main scanning direction, for example.

It is to be noted that in the above embodiment, the ink jet recording head has been described as an example of a liquid ejection head. However, the invention is widely applied to liquid ejection heads and it is needless to say that the invention can be also applied to a liquid ejection head which ejects liquid other than ink. As other liquid ejection heads, various recording heads used for an image recording apparatus such as a printer, a color material ejection head used for manufacturing a color filter such as a liquid crystal display, an electrode material ejection head used for forming an electrode such as an organic EL display and a field emission display (FED), a bioorganic compound ejection head used for manufacturing a bio chip, and the like can be exemplified.

The entire disclosure of Japanese Patent Application No. 2011-053623, filed Mar. 10, 2011 is incorporated by reference herein.

What is claimed is:

1. A liquid ejection head comprising:

a head main body which discharges liquid;

a flow path member main body on which a liquid reception member for receiving liquid supplied from the outside is formed;

a first case on which a window portion to which the liquid reception member of the flow path member main body faces is formed and which includes a first side wall that extends in a direction of the flow path member main body on a periphery;

a second case on which a liquid supply path for receiving liquid supplied from the liquid reception member of the flow path member main body is formed and which includes a second side wall that extends in a direction of the flow path member main body and forms an outer wall on a periphery of a case together with the first side wall; and a first insertion portion which is provided on the flow path member main body and through which a securing member for securing the first case, the second case, and the flow path member main body to one another is inserted, wherein the first insertion portion is formed such that the outer wall covers an exposing portion from which the securing member is exposed.

2. The liquid ejection head according to claim 1, further including a circuit substrate which is arranged between the flow path member main body and the second case and supplies an electric signal to a pressure generation element of the head main body, wherein the first insertion portion is provided between the circuit substrate and the outer wall of the case.

3. The liquid ejection head according to claim 1, further including:

a securing portion which is provided on the first case, and is inserted into the first insertion portion of the flow path member main body and to which the securing member is secured; and a second insertion portion which is provided on the second case and through which the securing member is inserted so as to engage with the first insertion portion of the flow path member main body, wherein a position of a boundary between the first side wall and the second side wall and a position at which the first insertion portion, the securing portion and the second insertion portion abut against one another are arranged to be different from each other in a direction in which the first case, the flow path member main body and the second case are laminated.

4. The liquid ejection head according to claim 1, wherein the outer wall formed by the first side wall and the second side wall corresponds to at least side walls at long sides of the case.

5. A liquid ejection apparatus comprising the liquid ejection head according to claim 1.

6. A liquid ejection apparatus comprising the liquid ejection head according to claim 2.

7. A liquid ejection apparatus comprising the liquid ejection head according to claim 3.

8. A liquid ejection apparatus comprising the liquid ejection head according to claim 4.

* * * * *